US010427918B2

(12) United States Patent
Allpress

(10) Patent No.: US 10,427,918 B2
(45) Date of Patent: Oct. 1, 2019

(54) MECHANICAL CLAMPING ASSEMBLY

(71) Applicant: Albert Allpress, Bremerton, WA (US)

(72) Inventor: Albert Allpress, Bremerton, WA (US)

( * ) Notice: Subject to any disclaimer, the term of this patent is extended or adjusted under 35 U.S.C. 154(b) by 0 days.

(21) Appl. No.: 14/093,167

(22) Filed: Nov. 29, 2013

(65) Prior Publication Data

US 2015/0151951 A1 Jun. 4, 2015

(51) Int. Cl.
*B66C 1/42* (2006.01)

(52) U.S. Cl.
CPC ..... *B66C 1/422* (2013.01)

(58) Field of Classification Search
CPC ... B66C 1/422; B66C 1/42; B66C 1/44; E02F 3/962; B25J 15/00; B25J 7/00; B23Q 7/04; B65G 47/90; B81C 99/002
See application file for complete search history.

(56) References Cited

U.S. PATENT DOCUMENTS 396,881 A * 1/1889 Lander
584,880 A * 6/1897 Knox
802,438 A * 3/1905 White et al.
1,150,671 A * 8/1915 Golden ..... B66C 1/422 294/106
1,356,515 A * 10/1920 Burgson ..... B66C 3/04 294/106
1,732,976 A * 10/1929 Mathews ..... B66C 1/585 294/106
2,916,322 A * 12/1959 Wirkkala ..... A01G 23/003 294/112
5,620,298 A * 4/1997 Barwise ..... B66C 1/585 294/201
9,242,840 B2 * 1/2016 Wenner ..... B66C 23/44

* cited by examiner

*Primary Examiner* — Stephen A Vu
(74) *Attorney, Agent, or Firm* — Larson & Larson, P.A.; Frank Liebenow; Justin P. Miller

(57) ABSTRACT

A clamping assembly is disclosed including a plurality of tines each pivotally coupled to a spreader having first ends above the spreader and second ends below the spreader. The first ends are coupled to lines joined at a common coupler and the second ends include hooked portions. The tines may have a planar shape and fit within radial slots defined by the spreader. The second ends may include slanted lower surfaces that slope upward with distance inward toward a center of the clamping assembly. In use the tines are lowered over an object. Tension applied to the lines causes pivoting of the tines effective to exert a clamping force on the object.

14 Claims, 7 Drawing Sheets

MECHANICAL CLAMPING ASSEMBLY

FIELD OF THE INVENTION

The present invention relates to material handling devices and, more specifically, to a mechanical pinch clamping assembly.

BACKGROUND OF THE INVENTION

Moving large objects such as rocks for use in a rock wall frequently requires handling devices such as grappler assemblies. Often a hydraulic thumb can be used with a fork or lift to capture the object to be moved. In lieu of the thumb attachment a piece of chain or similar material is used to wrap around the object to be moved, which is time consuming. This also poses a safety issue because the chain tends to slip as a person tries to pick up the rock, together with the fact that you may have to take many attempts to get the chain to actually grip the rock.

SUMMARY OF THE INVENTION

In one aspect of the invention, an apparatus for lifting objects includes two or more tines each having first and second ends. The first ends define an attachment point and the second ends define hooked portions. The two or more tines pivotally secure to a spreader between the first and second ends thereof.

In another aspect of the invention, the spreader defines at least two slots each sized to receive one of the two or more tines, the slots extend radially outward from a common point and are uniformly and circumferentially distributed about the common point and radially offset from the common point by a same distance. The two or more tines may have an oblong cross section at a point of attachment to the spreader such that the two or more tines each have a longer dimension of the oblong cross section thereof aligned with a longer dimension of a slot. In another aspect, the two or more tines are pivotally secured to the spreader by pins each spanning at slot of the at least two slots and passing through a tine of the at least two tines.

In another aspect, at least two chain portions each secured at a first end thereof to the attachment point of one of the tines of the two or more tines, the at least two chains being secured to one another at second ends thereof. The two or more tines may include an inner surface facing the spreader, the attachment point and hooked portion both protruding inwardly toward the spreader from the inner surface. The attachment point may protrude inwardly toward the spreader from the inner surface a greater extent then the hooked portion.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
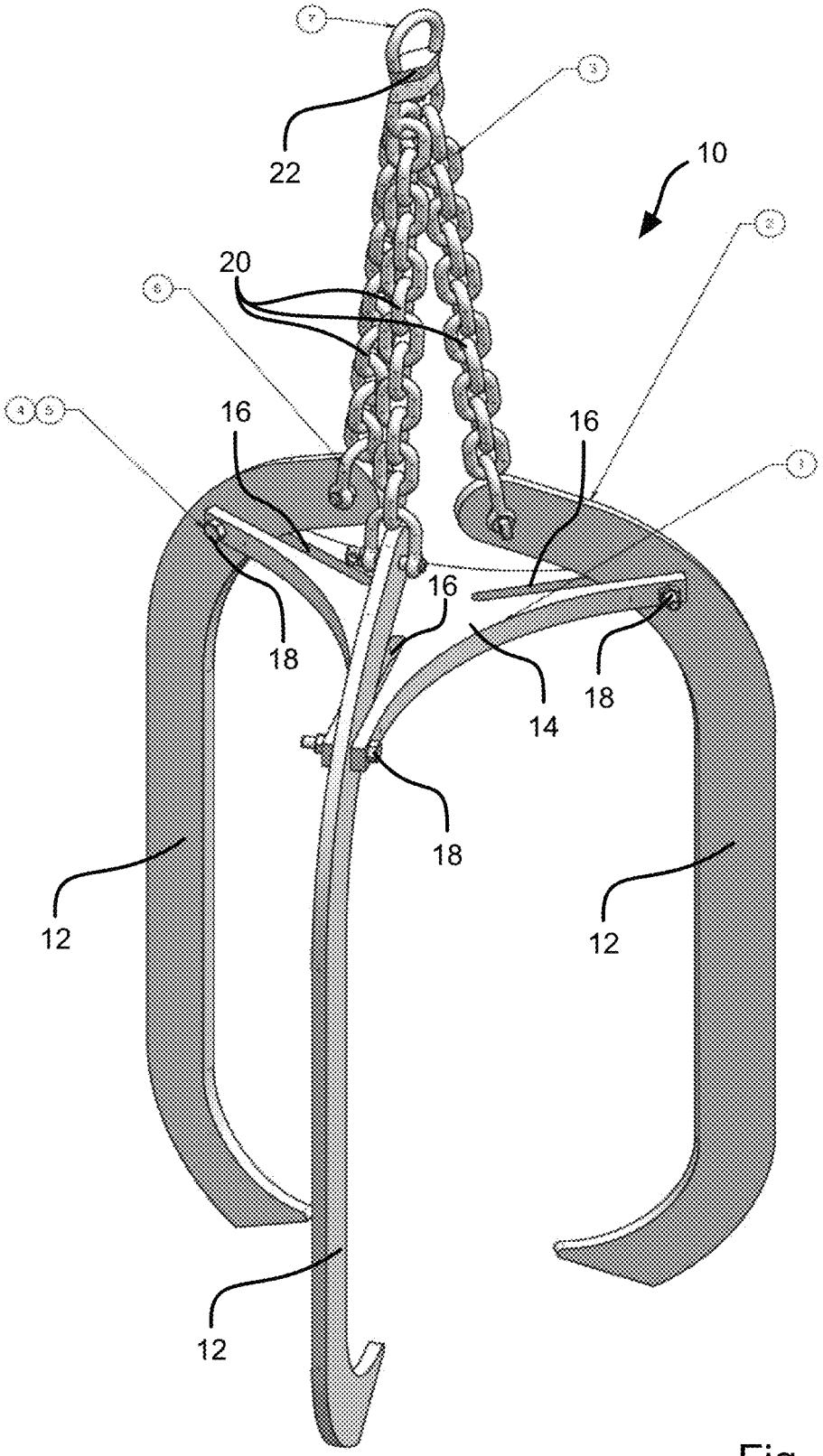
FIG. 1 is an isometric view of a clamping assembly in accordance with an embodiment of the invention.

Referring to FIG. 1, a clamping assembly 10 may include two or more, preferably three, tines 12 each mounted to a spreader 14. The spreader 14 may include two or more slots 16, preferably three, radiating outwardly from a common center. The tines 12 may each be inserted within one of the slots 16 and pinned in the slot 16 by means of pins 18. The pins 18 may be bolts or other fasteners passing through both the slots 16 and tines 12 positioned therein. The tines 12 are coupled to one or more lines 20 above the spreader 14. In the illustrated embodiment, the lines 20 are chains and may be coupled to the pins 18 by means of shackles or other linking structure. However, the lines 20 may be cables, ropes, or other type of line capable of supporting the loads for a given application. In the illustrated embodiments, the lines 20 secure to a common coupler 22, such as by securing a link of each chain 20 to a common ring, or separate rings, mounted to a common coupler 22. The coupler 22 may be mounted to another line, such as a chain, that is mounted to a device for raising and lowering the clamping assembly 10. In some embodiments, the coupler 22 may incorporate a swivel that allows for rotation of the clamping assembly 10. For example, the coupler 22 or a line to which it is coupled may be coupled to hydraulically actuated arm of a front loader, back hoe, or other machinery either directly or by mounting to a shovel mounted to such an arm. The tines 12, spreader 14, chains 20, and other components of the clamping assembly 10 may be made of any suitable material for the loads of a given application. In some embodiment, some or all of the components of the clamping assembly 10 are formed of mile steel plate for ease of manufacturing.

Figure 2:
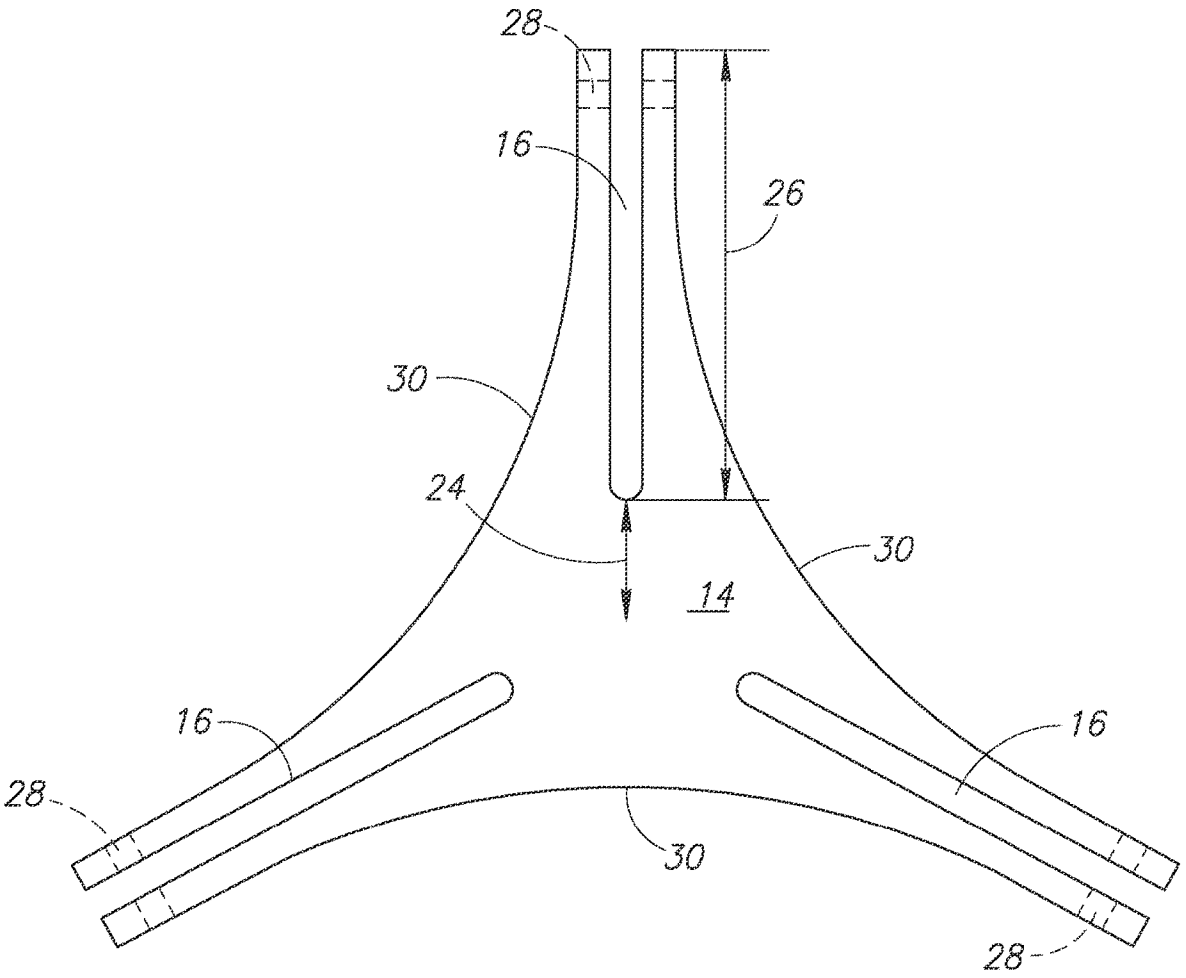
FIG. 2 is a top plan view of a spreader in accordance with an embodiment of the invention.

Referring to FIG. 2, as noted above the slots 16 extend outwardly from a common center. In particular, each slot 16 may be offset from the common center by a distance 24 and have an extent 26 outward from the offset distance 24. As is readily apparent, the extent 24 is many times larger, e.g. between 10 and 20 times larger, than the width of the slots 16, e.g. a width tangential to a circle around the common center. Apertures 28 for receiving the pins 18 may pass through the spreader 14 in the vicinity of each slot 16. In particular, apertures 28 may pass through the spreader perpendicular to the slots such that portions of each aperture are positioned on either side of a slot 16. For example, apertures may extend through the spreader 14 in a tangential direction to a ring about the common center.

In some embodiments, cutouts 30, such as arcuate cutouts 30, defined in the spreader 14 and positioned between slots 16 may leave prongs or strips of material on either side of the slots 16 and reduce the amount of material required to form the spreader 14. Alternatively, in some embodiments, the spreader 14 may have a generally circular shape having the slots 16 defined therein and the cutouts 30 may be omitted.

Figure 3B:
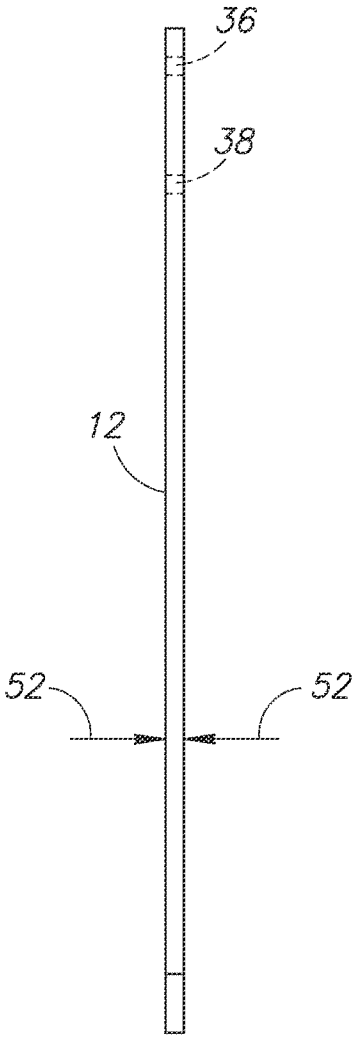
FIGS. 3A and 3B illustrate a tine in accordance with an embodiment of the invention.
Figure 3A:
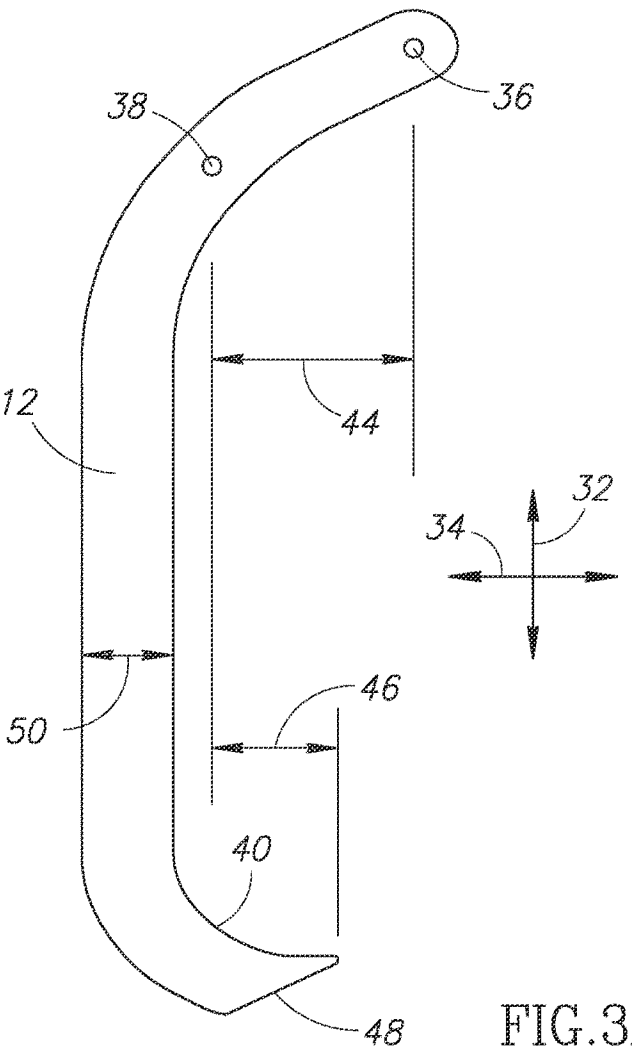

Referring to FIGS. 3A and 3B, a tine 12 may be understood with respect to a vertical direction 32 and a horizontal direction 34 that correspond generally to the horizontal and vertical directions of the clamping assembly 10 in use, though variation from an absolute horizontal and vertical direction may occur. The tine 12 may define an aperture 36, or other attachment structure such as a slot or hook, for securing to a line 20. The tine 12 may also define an aperture 38 for receiving a pin 18 securing the tine 12 to the spreader 14. A hooked portion 40 of the tine 12 is used to engage and lift objects. In the illustrated embodiment, the end of the spreader 14 is closer to the aperture 36 than to the end of the hooked portion 40. For example, along a vertical separation between the aperture 36 and the end of the hooked portion 40 may be more than two times, preferably more than four times, and more preferably eight times, a vertical separation between apertures 36 and 38. An inner surface 42 of the tine may extend along the vertical direction 32 between the hooked portion 40 and the apertures 36, 38. In some embodiments, the vertical direction 32 may be defined as being parallel to the inner surface 42. In other embodiments, the inner surface may be curved, angled, or have some other shape. Stated differently, the apertures 36, 38 and the distal end of the hooked portion 40 like along a concave curve that faces inwardly toward the other tines 12, i.e. the common center of the spreader 14. In this manner, pivoting due to an upward force on the aperture 36 may pivot the hooked portion 40 inward and provide a surface positioned under an object to facilitate lifting.

The aperture 36 may be located closest to a common center of the spreader 14 along the horizontal direction 34. The aperture 38 may be spaced outwardly from the aperture 36 (e.g. away from the common center) by a distance 44 and the end of the hooked portion 40 may be spaced inwardly (closer to the common center) from the aperture 38 by a distance 46. The distance 46 may be less than the distance 44, e.g. between 90 and 60 percent of the distance 44.

As is apparent in FIG. 3A, the hooked portion 40 may include a curved surface that transitions from a vertical direction aligned with the inner surface 42 to a horizontal portion perpendicular to the inner surface 42. The transition may be a circular arc or some other smooth surface or may be a simple angled junction. Although the distal end of the hooked portion 40 has a planar upper surface as shown in FIG. 3A, in other embodiments it may angle upward or downward relative to the horizontal direction 34.

In some embodiments, the hooked portion 40 may include a slanted, sloped, or contoured lower surface 48 that facilitates guidance of objects into a volume between the two or more tines 12. In particular, the lower surface 48 may slope upward with distance along the horizontal direction 34 away from the inner surface 42. The slope may be constant or non-constant, e.g. the slope may increase with distance from the inner surface 42.

Referring specifically to FIG. 3B, the tines 12 may advantageously have a planar shape such that the width 50 thereof is much greater than the thickness 52 thereof. In this manner, the tines 12 may fit within the narrow slots 16 of the spreader 14. For example, the width 50 may be between 4 and 8 times the thickness 52. In the illustrated embodiment, the width 50 of the tine 12 is substantially constant along the length thereof other than rounding at an upper end and narrowing of the hooked portion 40 due to the sloped lower surface 48. However, variable width and/or thickness may also be used.

Figure 4A:
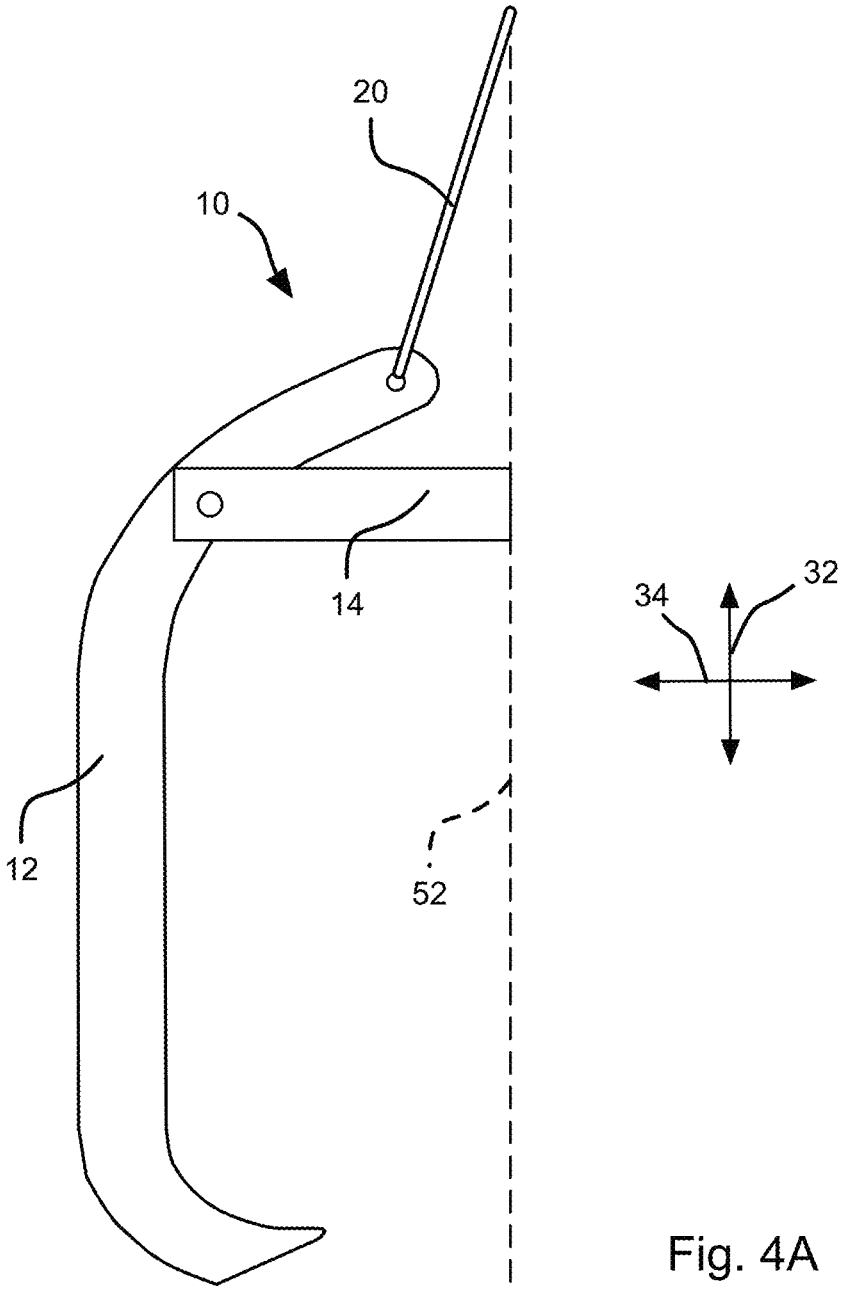
FIGS. 4A through 4C are side views showing use of the clamping assembly in accordance with an embodiment of the invention.

Referring to FIG. 4A, in preparation for use, the tines 12 may be suspended from the lines 20 in the illustrated configuration. The tines 12 may have a resting orientation in the absence of a load positioned between them. The tines 12 may be symmetrical about a common axis 54 that may also correspond to the common central point of the spreader 14 mentioned above. Accordingly, the other tines may behave in the same manner as the tine 12 illustrated in FIGS. 4A-4C.

Figure 4B:
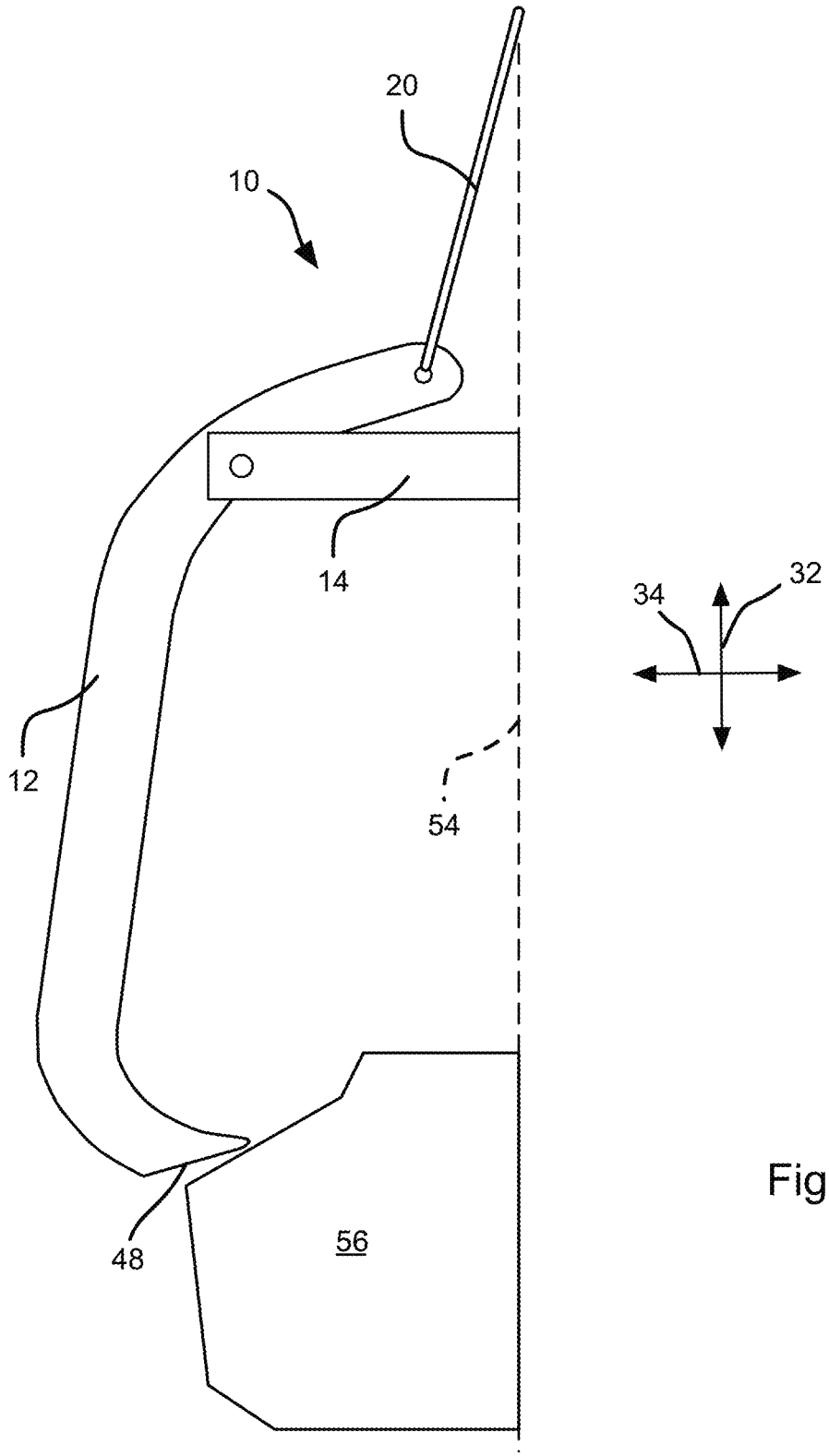
Figure 4C:
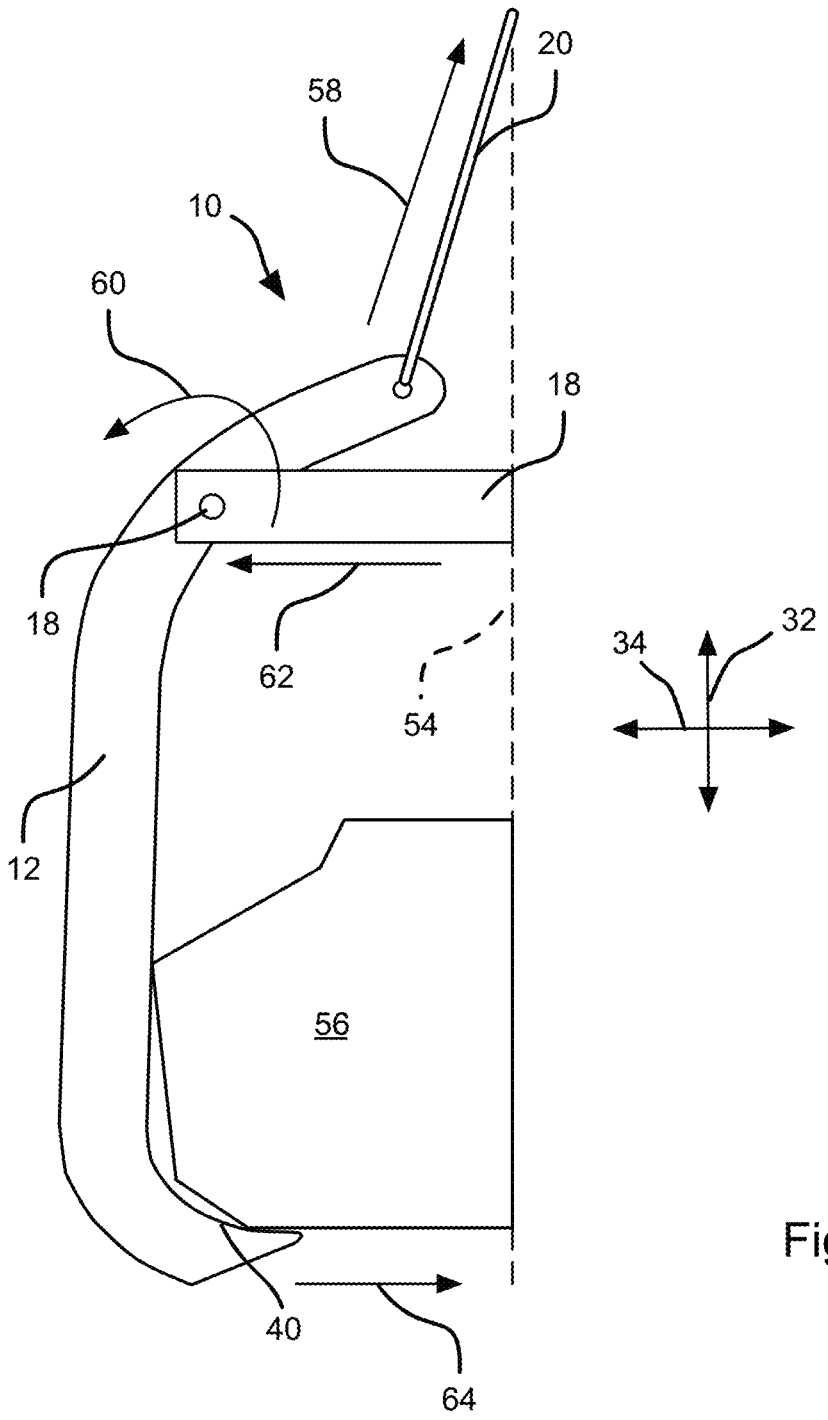

Referring to FIG. 4B, an object 56 may be positioned between the tines 12 by lowering the tines 12 over the object 56. The sloped lower surface 48 may advantageously guide and urge the lower ends of the tines 12 around the object 56. Referring to FIG. 4C, upon lifting up on the lines 20, tension 58 on the lines 20 creates a moment 60 about the pin 18. Due to the outward force 62 of the spreader 14, the hooked portion 40 of the tine 12 is constrained to exert an inward force 64 on the object 56. The combined inward forces of the tines 12 retain the object 56 during subsequent lifting and transportation of the object 56. The inward force 64 is dependent on the tension 58, which is dependent on the weight of the object 56 being lifted. Accordingly, the inward force 64 increases with the weight of the object thereby applying an appropriate clamping force. Upon deposition, the tines 12 may be disengaged by lowering the clamping assembly 10 and moving the clamping assembly 10 laterally without lifting such that clamping force does not prevent the object from moving out from among the tines 12.

Figure 5:
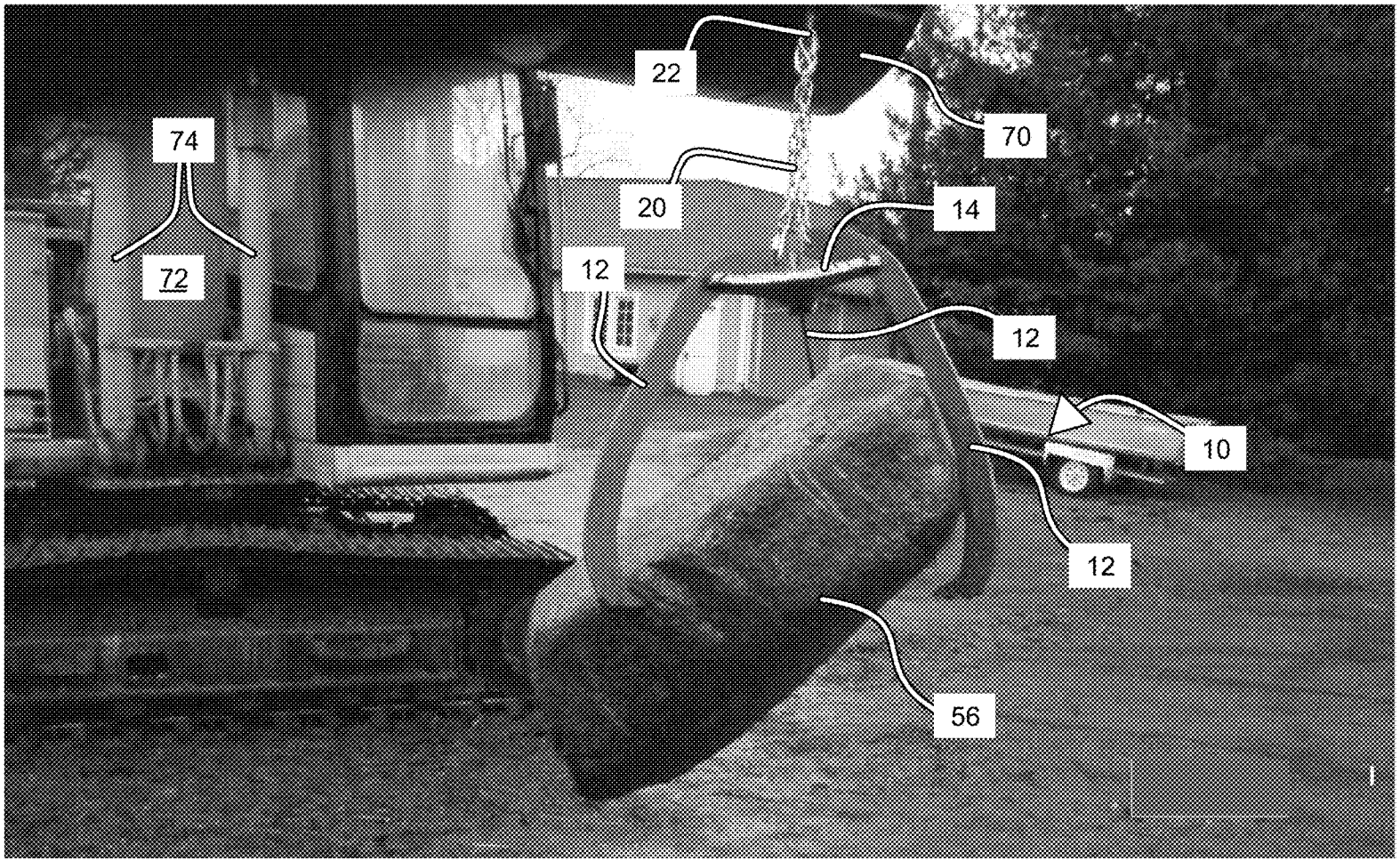
FIG. 5 illustrates a clamping assembly coupled to a hydraulically actuated shovel of a tracked vehicle in accordance with an embodiment of the present invention.

Referring to FIG. 5, as noted above, the lines 20 and common coupler 22 may be coupled to a shovel 70 of a tracked vehicle 72. For example, the shovel 70 may be mounted to hydraulic actuators 74 either with or without an intervening arm (not shown) that itself may be articulated and hydraulically actuated. Alternatively, the coupler 22 may be connected to a cable or chain connected to a pulley system, driven spool, or other cable actuating mechanism for raising and lowering the clamping assembly 10.

While the preferred embodiment of the invention has been illustrated and described, as noted above, many changes can be made without departing from the spirit and scope of the invention. Spreader bars and tine sizes may be altered to facilitate various sizes of objects to be moved. Load capacity and strength of chains and swivels may be altered based on considerations relative to the size and weight of the anticipated weight of the objects to be moved/lifted. Likewise, the material used to construct the components may vary according to availability, strength and other considerations. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus for lifting objects, the apparatus comprising:

two or more tines each having first and second ends, the first ends defining an attachment point, the second ends defining hooked portions;

two or more lines, the attachment point of each tine is attached to a first end of one of the two or more lines; and a spreader, each of the two or more tines pivotally secured to the spreader between the first and second ends thereof;

wherein the two or more tines include an inner surface facing the spreader, the attachment point and hooked portion both protruding inwardly toward the spreader from the inner surface.

2. The apparatus of claim 1, wherein the spreader comprises a slot corresponding to each tine of the two or more tines, each slot is sized to receive one of the two or more tines, each slot extends radially outward circumferentially distributed about a common point.

3. The apparatus of claim 2, wherein the each tine of the two or more tines is pivotally secured to the spreader by pins that hingedly connect the each tine to the spreader.

4. The apparatus of claim 1, wherein each line is selected from the group consisting of a chain, a rope, and a cable spreader.

5. The apparatus of claim 1, wherein the attachment point protrudes inwardly toward the spreader from the inner surface a greater extent then the hooked portion.

6. The apparatus of claim 1, wherein the two or more tines include at least three tines.

7. An apparatus for lifting objects, the apparatus comprising:

a spreader defining at least three slots radiating outwardly and equally spaced from each other;

at least three tines, each of the tines pivotally mounted within one of the slots of the at least three slots, each tine of the at least three tines including an inner surface facing the spreader;

an attachment point at a first end of each tine of the at least three tines;

a hook portion protruding inwardly from the inner surface of a distal second end of each tine of the at least three tines, the spreader being positioned between the attachment point and the hook portion; and at least three lines, a first end of each of the at least three lines secured to the attachment point of one of the tines of the at least three tines, a second end of the at least three lines fastened to one another.

8. The apparatus of claim 7, further comprising a hydraulically actuated arm coupled to the second ends of the at least three lines.

9. The apparatus of claim 8, further comprising a shovel secured to the hydraulically actuated arm, the second ends of the at least three lines being secured to the shovel.

10. The apparatus of claim 7, wherein the at least three tines further each include a slanted surface on the hooked portion thereof and facing away from the spreader, the slanted surface sloping outwardly relative to the inner surface with proximity to the spreader.

11. The apparatus of claim 7, wherein the at least three tines have an oblong cross section.

12. The apparatus of claim 7, further comprising at least three pins spanning the at least three slots, each pin extending through one of the at least three tines.

13. The apparatus of claim 7, wherein radially outer ends of the slots are open.

14. The apparatus of claim 7, wherein the at least three lines are chains.

* * * * *